United States Patent [19]

McAllister

[11] 4,245,175

[45] Jan. 13, 1981

[54] METAL HALIDE LAMP HAVING LEAD METAL POWDER TO REDUCE BLACKENING

[75] Inventor: William A. McAllister, Morris Township, Morris County, N.J.

[73] Assignee: Westinghouse Electric Corp., Pittsburgh, Pa.

[21] Appl. No.: 967,809

[22] Filed: Dec. 8, 1978

[51] Int. Cl.[3] ..... H01J 17/20; H01J 61/18

[52] U.S. Cl. ..... 313/229

[58] Field of Search ..... 313/229

[56] References Cited

U.S. PATENT DOCUMENTS

| | | | |
|---|---|---|---|
| 3,398,312 | 8/1968 | Edris et al. | 313/229 X |
| 3,407,327 | 10/1968 | Koury et al. | 313/229 |
| 3,513,344 | 5/1970 | Larson | 313/229 X |
| 3,521,110 | 7/1970 | Johnson | 313/227 |
| 4,001,626 | 1/1977 | Drop et al. | 313/229 |

*Primary Examiner*—Robert Segal

*Attorney, Agent, or Firm*—B. R. Studebaker

[57] ABSTRACT

A high pressure metal halide discharge lamp of the sodium-scandium type which has the maintenance thereof improved by the addition of a small quantity of lead metal powder. The lead metal powder is added to the discharge sustaining fill in an amount of from between about 0.4 and 1.2 wt. % of the total amount of discharge sustaining fill.

1 Claim, 1 Drawing Figure

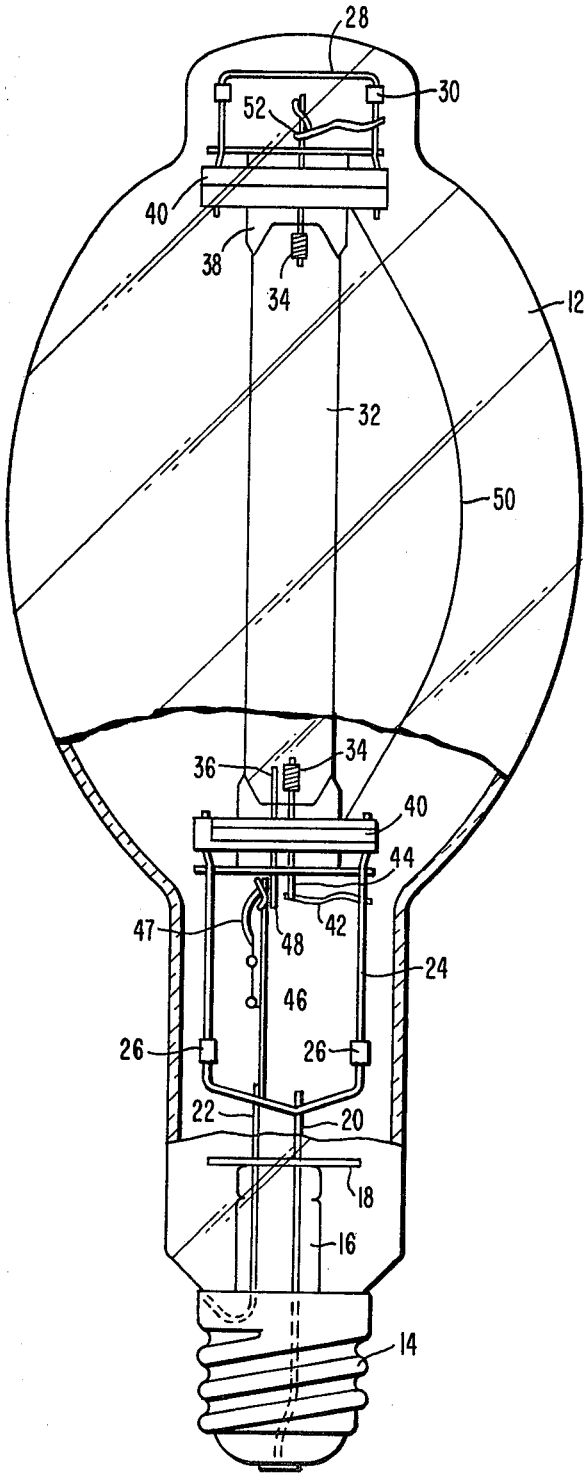
28
30
52
40
38
34
12
32
50
36
34
40
44
47
48
42
24
46
26
26
22
20
18
16
14

METAL HALIDE LAMP HAVING LEAD METAL POWDER TO REDUCE BLACKENING

BACKGROUND OF THE INVENTION

This invention relates to a high pressure metal halide discharge lamp of the sodium scandium type and more particularly to a metal halide discharge lamp having improved maintenance during its life.

The high pressure sodium-scandium discharge lamp is well known and widely used because of its relatively high efficiency and good color rendition. The basic concept of this type lamp is disclosed in U.S. Pat. No. 3,407,327, issued Oct. 22, 1968 to Koury et al. and is basically a discharge lamp containing predetermined quantities of mercuric iodide, sodium iodide, mercury and scandium metal in the discharge sustaining fill.

As with most discharge lamps, lamp efficiency tends to diminish somewhat during life. This less than desirable lamp maintenance, in part, results from the fact that a dark film tends to form on the arc tube body. Spectrographic analysis of this black residue discloses a number of metal impurities. Surprisingly, it has been found that the addition of a relatively small quantity of lead metal powder to the discharge sustaining fill will improve the maintenance of the standard sodium-scandium lamp.

Lead in the form of lead iodide has been added to the discharge sustaining fill of high pressure vapor discharge lamps in the past. One such teaching of the addition of lead iodide to the discharge sustaining fill of a high pressure discharge lamp can be found in U.S. Pat. No. 3,513,344, issued May 19, 1970 to D. A. Larson. Prior discharge lamps containing the lead iodide additive were primarily for photocopying processes and a light source for illuminating fluorescent signboards and contained a discharge sustaining fill which was in excess of 25 wt.% lead iodide. These lamps also had rather low efficiencies in a range of from 22 to 32 lumens per watt. A typical 1,000 watt sodium-scandium lamp will have an efficiency of about 100 lumens per watt.

SUMMARY OF THE INVENTION

This invention provides for the improvement of the maintenance of a high pressure metal halide discharge lamp of the sodium-scandium type which includes predetermined amounts of scandium metal, mercuric iodide, sodium iodide and mercury to form the discharge sustaining fill by the addition of a small amount of lead metal powder to that discharge sustaining fill. More specifically, the scandium metal is present in an amount of from between about 0.8 to 2.0 wt.%; the mercuric iodide is present in an amount of from between about 4.8 and 6.8 wt.%; the sodium iodide is present in an amount of from between about 30.0 and 44.0 wt.%; the mercury is present in an amount of from between about 56.0 and 62.0 wt.%; and the lead metal powder is present in an amount of from between 0.4 and 1.2 wt.%.

BRIEF DESCRIPTION OF THE DRAWING

Many of the attendant advantages of the present invention will become more readily apparent and better understood as the following detailed description is considered in connection with the accompanying drawing in which, the sole FIGURE, is a side elevational view partly in section of a typical 1,000 watt metal halide discharge lamp.

DESCRIPTION OF THE PREFERRED EMBODIMENT

FIG. 1 of the drawing illustrates a typical 1,000 watt metal halide discharge lamp which includes a bulbous tubular outer envelope 12 sealed to a standard mogal base 14 and includes a reentrant stem press 16 which has mounted thereon a heat reflecting disk shield 18 and a pair of lead-in conductors 20 and 22 extending therethrough and electrically connected to the base 14. The lower support frame 24 is mounted to the lead-in conductor 20 and is supported within the tubular neck of the bulb in a conventional manner by springs 26. A shorter but similar frame 28 is mounted in the upper tubular end of the bulb and is retained therein by springs 30. Mounted between the lower frame 26 and the upper frame 28 is a conventional quartz arc tube 32 having a pair of discharge sustaining electrodes 34 mounted in each end thereof and a starting electrode 36 mounted in the lower end through the press seals 38. The arc tube is mounted to the upper and lower support frames 24 and 28 by metal support straps 40 which extend between the legs of the support frames and clamp the press seals 38 at each end of the arc tube. A connector 42 electrically connects the lower frame 24 to the rod or lead 44 of the lower electrode 34. A supplemental lead circuit 46 including a bi-metal switch 47 is connected between the lead-in conductor 22 and the stem or lead 48 of the starting electrode 36 in a conventional manner. A field wire or lead wire 50 interconnects the supplemental lead circuit 46 to the lead 52 of the upper electrode 34 to energize the upper electrode 34 also in a conventional manner.

In a typical sodium-scandium metal halide lamp, the discharge sustaining fill includes a starting or fill gas as, for example, 20 to 25 millimeters of argon plus a predetermined quantity of mercury, sodium iodide, scandium metal and mercuric iodide. Preferably, the mercury is present in an amount of from between about 56 to 62 wt.%, the sodium iodide is present in an amount from between about 30.0 to 44.0 wt.%, the scandium metal is present in an amount of from between about 0.8 to 2.0 wt.% and the mercuric iodide is present in an amount of from between about 4.8 and 6.8 wt.%. In a typical 1,000 watt lamp, there would be present from 2 to 5 milligrams of scandium metal from 12 to 17 milligrams of mercuric iodide from 75 to 110 milligrams of sodium iodide and from 140 to 155 milligrams of mercury. In accordance with the present invention to this typically loaded lamp from between about 1 to 3 milligrams, or 0.4 to 1.2 wt.% of lead metal powder is added to increase the lamp maintenance during life. The addition of this small amount of lead metal powder to the discharge sustaining fill apparently has no effect on the spectral lines present as compared to the standard lamp although in some instances, they appear to be of greater intensity.

Several groups of experimental lamps were prepared which included 2 milligrams of scandium metal, 16 milligrams of mercuric iodide, 80 milligrams of sodium iodide and 148 milligrams of mercury. In the first group, one lamp had no lead metal powder added and had a 78% maintenance at 1,000 hours. Lamps containing between 0.4 and 1.2% by weight of lead metal powder had an average maintenance at 1,000 hours of 90%. In the second group of experimental lamps, two control lamps were compared to two similar lamps having 2 milligrams of lead metal powder added. The control lamps averaged about 57% maintenance at 4,900 hours whereas the lamps having the 2 milligrams of lead metal powder added averaged 73% maintenance at 4,900 hours.

The following charts illustrate the performance of the experimental lamps of Group I and Group II:

| Group I - (1,000 watt) | | | |
|---|---|---|---|
| Wgt. of Pb added (mg) | Efficacy (l/w) at 100 hrs. | Efficacy (l/w) at 1000 hrs. | Percent Maintenance |
| None | 106 | 83 | 78 |
| 1 | 108 | 97 | 90 |
| 2 | 97 | 88 | 91 |
| 3 | 101 | 89 | 88 |

| Group II - (1,000 watt) | 0 hrs. | 290 hrs. | 2570 hrs. | 4900 hrs. | Percent Maintenance |
|---|---|---|---|---|---|
| Control | 114 | 103 | 88 | 72 | 63 |
| Control | 113 | 102 | 71 | 58 | 51 |
| lead (2 mg) | 102 | 109 | 91 | 76 | 75 |

-continued

| Group II - (1,000 watt) | 0 hrs. | 290 hrs. | 2570 hrs. | 4900 hrs. | Percent Maintenance |
|---|---|---|---|---|---|
| lead (2 mg) | 104 | 93 | 91 | 74 | 71 |

As will be seen from the foregoing, although metal impurities have been found to constitute the darkened portion of an arc tube body toward the end of lamp life, the addition of small quantities of lead metal powder to the discharge sustaining fill of a sodium-scandium lamp has surprisingly improved that lamp's maintenance during lamp life.

What is claimed is:

1. A high pressure discharge lamp of the metal halide type, said lamp comprising:

an outer envelope sealed to a metal base;

an arc tube mounted within said outer envelope having a pair of discharge sustaining electrodes at each end thereof, said discharge sustaining electrodes being electrically connected to said metal base; and a discharge sustaining fill, within said arc tube, said discharge sustaining fill including about 2 milligrams of scandium metal, about 16 milligrams of mercuric iodide, about 80 milligrams of sodium iodide, and about 148 milligrams of mercury, and wherein about 2 milligrams of lead metal powder is added to the discharge sustaining fill to enhance the maintenance of said lamp.

* * * * *